US010288298B2

(12) United States Patent
Chadwick et al.

(10) Patent No.: US 10,288,298 B2
(45) **Date of Patent: *May 14, 2019**

(54) HOME COOKING APPLIANCE HAVING A LOW-PROFILE REAR VENT TRIM

(71) Applicant: BSH Home Appliances Corporation, Irvine, CA (US)

(72) Inventors: Temple Chadwick, New Bern, NC (US); David Dysinger, New Bern, NC (US); Tiffany E. Ingersoll, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 519 days.

This patent is subject to a terminal disclaimer.

(21) Appl. No.: 14/205,587

(22) Filed: Mar. 12, 2014

(65) Prior Publication Data

US 2015/0260416 A1 Sep. 17, 2015

(51) Int. Cl.
*F24C 15/20* (2006.01)
*F24C 15/00* (2006.01)

(52) U.S. Cl.
CPC ..... *F24C 15/2042* (2013.01); *F24C 15/006* (2013.01); *F24C 15/2007* (2013.01)

(58) Field of Classification Search
CPC ..... F24C 15/2007; F24C 15/006; F24C 15/2042; F24C 15/005
USPC ..... 126/21 A, 21 R, 15 A, 31, 15 R, 273
See application file for complete search history.

(56) References Cited

U.S. PATENT DOCUMENTS 2,526,890 A * 10/1950 Mendel ..... F24C 3/027 126/190
3,290,483 A * 12/1966 Hurko ..... F24C 14/02 126/15 R
3,499,431 A * 3/1970 McArthur, Jr. ..... F24C 3/087 126/21 R
3,832,988 A * 9/1974 Doner ..... F24C 15/2007 126/21 R
4,024,839 A 5/1977 Reid, Jr. et al.
4,527,542 A * 7/1985 Bales ..... F24C 15/2007 126/21 R
5,019,682 A 5/1991 Lee
6,098,613 A 8/2000 Wiersman
6,172,338 B1 * 1/2001 Barnes ..... F24C 15/006 126/21 R (Continued)

FOREIGN PATENT DOCUMENTS

CN 1766425 A 5/2006
CN 1291188 C 12/2006

(Continued)

*Primary Examiner* — Avinash A Savani
*Assistant Examiner* — Rabeeul Zuberi
(74) *Attorney, Agent, or Firm* — Michael E. Tschupp; Andre Pallapies; Brandon G. Braun

(57) ABSTRACT

A home cooking appliance includes a housing, a cooking surface on a top of the housing, the cooking surface having an upper surface, and a rear vent trim on the top of the housing and at a rear side of the top of the housing. The rear vent trim has an upper surface that is substantially flush with the upper surface of the cooking surface. The rear vent trim includes an opening permitting air to exit from within the rear vent trim, and the rear vent trim directs the air away from a 90° angle with respect to the upper surface of the cooking surface.

33 Claims, 14 Drawing Sheets

(56) References Cited

U.S. PATENT DOCUMENTS

| | | | | |
|---|---|---|---|---|
| 6,761,159 | B1 | 7/2004 | Barnes et al. | |
| 7,923,663 | B2 | 4/2011 | Kim et al. | |
| 8,333,183 | B2 * | 12/2012 | Nam | F24C 15/006 126/273 R |
| 2007/0074713 | A1 * | 4/2007 | Cadima | F24C 15/006 126/21 R |
| 2012/0152224 | A1 | 6/2012 | Chilton et al. | |
| 2013/0125764 | A1 * | 5/2013 | Jeong | F24C 15/2035 99/357 |

FOREIGN PATENT DOCUMENTS

| | | | |
|---|---|---|---|
| EP | 0833108 | A1 | 4/1998 |
| GB | 2349457 | A | 11/2000 |
| KR | 20070092802 | A | 9/2007 |

* cited by examiner

HOME COOKING APPLIANCE HAVING A LOW-PROFILE REAR VENT TRIM

CROSS-REFERENCES TO RELATED APPLICATIONS

This application is related to Applicants' co-pending U.S. applications, which are filed concurrently herewith, entitled "HOME COOKING APPLIANCE HAVING A FLUE BOUNDARY," filed concurrently herewith, Ser. No. 14/205,597; and "HOME COOKING APPLIANCE HAVING AN AIR CHANNEL," filed concurrently herewith, Ser. No. 14/205,593, each of which is incorporated herein by reference in its entirety.

FIELD OF THE INVENTION

The present invention is directed to a home cooking appliance having a rear vent trim, and more particularly, to a home cooking appliance having a low profile, rear vent trim that is substantially flush with cooking grates of the home cooking appliance and that directs air flow away from a back wall behind the appliance.

BACKGROUND OF THE INVENTION

A conventional home cooking appliance, such as a slide-in gas range, includes a housing having a cooking compartment, such as a baking oven, convection oven, steam oven, warming drawer, etc., and a cooking surface formed, for example, by cooking grates disposed over gas burners on top of the housing. The appliance must exhaust the flue gases from the cooking compartment to maintain safe temperatures, acceptable combustion, etc. within the cooking compartment. To do this, a conventional home cooking appliance commonly includes a raised or elevated exhaust vent at a rear of the appliance that exhausts flue gases upward from the housing in a vertical direction (i.e., at a 90° angle with respect to with respect to the surface of the cooktop or cooking grates), for example, to try to keep the hot flue gases from blowing on a user of the appliance and also to avoid the flue gases interfering with the operation of the gas burners. Conventional home cooking appliances typically require the rear vent trim to be a certain height above the cooking surface in order to exhaust the hot flue gas from the appliance without interfering with the operation of the burners.

A conventional slide-in range is installed in a cooking area of a home kitchen with a rear wall of the appliance facing a back wall of the kitchen. The appliance typically is disposed between counters with floor cabinets below the counters. The kitchen may include wall cabinets mounted on the back wall of the kitchen either over the cooking surface of the range or over the adjacent floor cabinets, and/or another appliance or component, such as an over-the-range (OTR) microwave oven or an OTR convection microwave oven over the cooking surface. Industry standards and regulations commonly dictate acceptable temperatures of the combustible back wall behind the appliance, acceptable temperatures of cabinets or components over the range or adjacent to the range, as well as acceptable door temperatures for the appliance, during high temperature events, such as during a self-cleaning cycle of the oven while all burners on the cooktop are on a highest heat setting.

Conventional appliances include various structures and techniques designed to manage and dissipate the hot air being exhausted from the appliance while complying with industry standards and regulations. In order to provide enough air flow through the appliance to maintain acceptable surface temperatures and oven door temperatures, and to protect all components, some conventional appliances include costly designs and door construction that increase the air flow through the door and/or include raised vent trims with greater air flow and louder fans. However, these designs can result in increased manufacturing costs and increased fan noise for the user.

For example, a conventional home cooking appliance may attempt to improve compliance with the industry standards and regulations by increasing a height of the rear vent above the cooking surface to exhaust the flue gases upward from the housing without interfering with the operation of the burners or directing the hot air toward the user. Another known manner of improving compliance with the industry standards and regulations is to increase an air flow through the appliance or an airflow exiting the appliance from the cooking compartment in order to improve compliance with the industry standards and regulations. However, increasing the air flow through the appliance or exiting over the appliance not only can disrupt the performance of the burners on the cooktop, but also can increase fan noise for the user.

Yet another known manner of improving compliance with the industry standards and regulations is to manage hot air with dilution flues, which allow cool air to flow into the flue and mix with the flue gases before exiting the flue in order to reduce outlet temperatures and protect the flue outlet and other components from unacceptable heat. However, a dilution flue typically requires a large amount of space in the housing of the appliance, and requires special tooling and expensive components, resulting in increased manufacturing costs.

Additionally, conventional home cooking appliances may require a rear wall of the appliance to be spaced from the combustible back wall by a certain amount of clearance in order to manage and dissipate hot air from the appliance in order to improve compliance with the industry standards and regulations.

SUMMARY OF THE INVENTION

The present invention, as illustrated for example in the exemplary embodiments, is directed to a home cooking appliance including a housing, a cooking surface on a top of the housing, the cooking surface having an upper surface, and a rear vent trim on the top of the housing and at a rear side of the top of the housing. The rear vent trim has an upper surface that is substantially flush with the upper surface of the cooking surface. The rear vent trim includes an opening permitting air to exit from within the rear vent trim, and the rear vent trim directs the air away from a 90° angle with respect to the upper surface of the cooking surface.

In this way, the present invention can provide a home cooking appliance having a rear vent trim that is substantially flush with an upper surface of the rear end of the cooking surface, thereby providing a low-profile and compact appliance that provides a "built-in" appearance that is desirable to a user, while at the same time, directing the flow of air forward away from a combustible back wall of the kitchen, which faces the rear wall of the appliance, and simultaneously reducing turbulence above the cooking surface, thereby minimizing temperatures on the combustible back wall of the kitchen and improving compliance with industry standards and regulations. The home cooking appliance also can reduce temperatures on other components, such as wall cabinets mounted on the back wall of the kitchen either over the cooking surface of the home cooking appliance or over the adjacent floor cabinets, and/or on another appliance or component, such as an over-the-range (OTR) microwave oven or an OTR convection microwave oven, thereby improving compliance with industry standards and regulations. Additionally, the home cooking appliance can manage and dissipate the hot air being exhausted from the appliance in a manner that contributes to a reduction in temperatures on surfaces or components of the home cooking appliance itself, such as temperatures on an oven door, thereby improving compliance with industry standards and regulations.

Other features and advantages of the present invention will be described below. To provide a better understanding of the invention, and for further clarification and background of the present invention, various aspects and considerations of a home cooking appliance having a rear vent trim, which have been recognized by the present invention, first will be explained in greater detail.

As explained above, in order to provide enough air flow through the appliance to maintain acceptable surface temperatures and oven door temperatures and to protect components, some conventional appliances include costly designs and door construction that increases the air flow through the door and/or include raised vent trims with greater air flow and louder fans. The conventional raised or elevated exhaust vent at the rear of the appliance exhausts flue gases upward from the housing in a vertical direction (i.e., at a 90° angle with respect to the surface of the cooktop or cooking grates), for example, to try to keep the hot flue gases from blowing on a user of the appliance and also to avoid the flue gases interfering with the operation of the gas burners. However, these designs can result in an increase in manufacturing costs as well as an increase in fan noise perceived by the user, which is a common complaint among consumers of conventional appliances.

Moreover, the present invention recognizes that a combination of factors, such as the rear vents being located at the rear of the cooking appliance away from the user, a low pressure at a surface of the back wall of the kitchen located behind the appliance, convective heat transfer from flue gases to the back wall of the kitchen, and the heated air exiting the rear vents in a vertical direction, can result in an increase in temperatures at areas of the back wall of the kitchen located behind the appliance, as well as at areas of other components that are adjacent to the appliance, such as wall-mounted kitchen cabinetry, other appliances such as an over-the-range (OTR) microwave. During operation of the appliance, cool air naturally flows in from the front of the range (from the kitchen). The hot air from the burners and oven naturally collect at the back wall, for example, due to factors such as, for example, a low pressure at a surface of the back wall and convective heat transfer from flue gases to the back wall of the kitchen. The present invention recognizes that if the air-flow is not controlled or optimized, this hot air may increase temperatures, and in some cases, result in damage to the combustible surfaces of the back wall or other components, such as an OTR microwave. The present invention also recognizes that, while the cook top burners are in operation, it is beneficial if the rear vent trim also directs the cook top heat away from the back wall without negatively affecting low simmer rates. Thus, the air-flow preferably can be managed in a way that reduces wall temperatures and component temperatures while maintaining passing combustion results at the gas burners and in the cooking compartment, while at the same time minimizing noise to the user.

The present invention solves these and other problems by providing a rear vent trim that controls and manages the air flow by directing the flow of air from the rear vent trim forward and away from a combustible back wall of the kitchen while simultaneously reducing turbulence above the cooking surface, thereby minimizing temperatures on the combustible back wall of the kitchen and improving compliance with industry standards and regulations, while also maintaining passing combustion results at the gas burners and the cooking compartment, minimizing noise to the user, and providing a low profile, rear vent trim that is substantially flush with cooking grates of the home cooking appliance. The present invention deviates from the conventional designs, which increase a height of the vent above the cooking surface, and instead provides a low-profile rear vent trim that is substantially flush with the cooking surface, which provides a "built-in" appearance that it desirable by many users. Additionally, the present invention deviates from the conventional designs, which exhaust flue gases upward from the housing in a vertical direction (i.e., at a 90° angle with respect to the surface of the cooktop or cooking grates), and instead provides a low-profile, substantially flush, rear vent trim that directs air away from a 90° angle with respect to the surface of the cooktop or cooking grates to direct the air flow from the rear vent trim forward and away from a combustible back wall of the kitchen, while simultaneously reducing turbulence above the cooking surface, and without increasing an air flow through the appliance or from the cooking compartment or increasing fan noise for the user.

The exemplary embodiments of a rear vent trim can include one or more openings for permitting air to exit from within the rear vent trim while directing the air away from the back wall. In an exemplary embodiment, the rear vent trim is configured to separate cooling air and flue gases and to exhaust the separate cooling air and flue gas from different openings in the rear vent trim while directing both the cooling air and flue gas away from the back wall. In another example, the rear vent trim directs the separate cooling air and flue gases away from the back wall and splits the air such that different streams of air are directed beneath the cooking grates and above the grates. For example, the rear vent trim directs the separate cooling air away from the back wall and in a direction above the cooking grates, and directs the flue gases away from the back wall and in a direction beneath the cooking grates.

In an exemplary embodiment, the rear vent trim is configured to provide three air-flow 'zones' for managing air-flow. In this example, the rear vent trim includes one or more first openings providing a first zone (Zone 1) in which air comes up from behind the range, exits the first openings, and gently blows up and forward to cool the back wall. The rear vent trim includes one or more second openings providing a second zone (Zone 2) such that, when the oven is ON and a cooling fan is running, air is gently directed out of the second openings at angles away from the burners such that the air does not disrupt the burner flame even when the burner is on the lowest settings. The air from the second zone works in combination with the air from the first zone to gently spin the combined air flow up in a vortex away from the back wall and upper cabinets, for example, like a reverse-Coanda effect. The rear vent trim includes one or more third openings in communication with one or more oven flues to provide a third zone (Zone 3) such that hot air/flue gas (oven combustion) flows up from the gas cooking compartment, exits the third openings in a direction away from the back wall, and gently wisps out onto the cooktop spill trays on the top of the housing. The hot air/flue gas of the third zone moves into the air-stream created by the first zone and the second zone and away from the back wall and upper cabinets (or components such as an OTR microwave). In a particular example, the rear vent trim directs the air of the second zone away from the back wall and above the cooking grates, while directing the hot air/flue gas of the third zone away from the back wall and beneath the cooking grates.

In this way, the features of the present invention can manage and dissipate the hot air being exhausted from the appliance to minimize or prevent convective heat transfer from flue gases to the back wall of the kitchen. As explained above, the present invention can provide a home cooking appliance having a rear vent trim that is substantially flush with an upper surface of the rear end of the cooking surface, thereby providing a low-profile and compact appliance that provides a "built-in" appearance that is desirable to a user. The flush design maximizes an amount of cooktop cooking surface.

At the same time, the present invention can provide a home cooking appliance having a rear vent trim that manages heat by directing the flow of air forward away from a combustible back wall of the kitchen, which faces the rear wall of the appliance, while simultaneously reducing turbulence above the cooking surface, thereby minimizing temperatures on the combustible back wall of the kitchen and improving compliance with industry standards and regulations. The home cooking appliance also can reduce temperatures on other components, such as wall cabinets mounted on the back wall of the kitchen either over the cooking surface of the home cooking appliance or over the adjacent floor cabinets, and/or on another appliance or component, such as an over-the-range (OTR) microwave oven or OTR convection microwave oven, thereby improving compliance with industry standards and regulations. Additionally, the home cooking appliance can manage and dissipate the hot air being exhausted from the appliance in a manner that contributes to a reduction in temperatures on surfaces or components of the home cooking appliance itself, such as temperatures on an oven door, thereby improving compliance with industry standards and regulations.

The features of the present invention also can minimize or eliminate a required minimum clearance between the rear wall of the appliance and a combustible back wall of the kitchen, which faces the rear wall of the appliance, while maintaining compliance with industry standards and regulations. In an exemplary embodiment, the features of the present invention enable the required minimum clearance between the rear wall of the appliance and the combustible back wall of the kitchen to be minimized to, for example, 3 mm, while maintaining compliance with industry standards and regulations. In another exemplary embodiment, the features of the present invention can eliminate any need for a required clearance between the rear wall of the appliance and the combustible back wall of the kitchen, thereby permitting the rear wall of the appliance to directly abut or contact the combustible back wall of the kitchen, while maintaining compliance with industry standards and regulations.

The features of the present invention also can manage and dissipate the hot air being exhausted from the appliance without interfering with the operation of the gas burners, thereby improving combustion at the gas burners. Particularly, the features of the present invention can increase an air flow for heat removal and dissipation without increasing the air flow over the burners, thereby avoiding interference with the operation of the burners, such as blowing out the burners. The features of the present invention also can reduce a pressure build-up around the flue outlet of the appliance, thereby avoiding interference with the operation of the flue and maintaining an acceptable combustion in the cooking compartment.

Moreover, the features of the present invention can increase an air flow for heat removal and dissipation without increasing a fan speed, and thus, without increasing fan noise.

The present invention also can provide a home cooking appliance with a rear vent that separates cooling air and flue gases that are exiting the appliance while directing the air away from the rear wall located behind the appliance, thereby reducing temperatures on the back wall of the kitchen and temperatures of other component temperatures while maintaining passing combustion results, for example, in the cooking compartment and at the gas burners.

The features of the present invention can be provided separately, or in combination with each other or in combination with other features of a home cooking appliance for managing and dissipating the hot air being exhausted from the appliance, thereby further improving compliance with industry standards and regulations.

The features of the present invention are not limited to any particular type of cooking appliance or to a cooking appliance having any particular arrangement of features. For example, one of ordinary skill in the art will recognize that the features of the present invention are not limited to a slide-in gas cooking appliance, and can include, for example, a built-in cooking appliance, an electric cooking appliance, or another cooking appliance that will benefit from directing the flow of air forward away from a combustible back wall of the kitchen or another component, while simultaneously reducing turbulence above the cooking surface, thereby minimizing temperatures on the combustible back wall of the kitchen or another component, and improving compliance with industry standards and regulations.

For purposes of this disclosure, the term "back wall" refers to a combustible wall of a kitchen, and the term "rear wall" refers to a rear wall of the housing of the home cooking appliance that faces the back wall of the kitchen when the appliance is in an installed position.

For purposes of this disclosure, an upper surface of the rear vent trim is substantially flush with an upper surface of the cooking surface if the upper surface of the rear vent trim is approximately level with the upper surface of the cooking surface, or for example, if at least the front edge or rear edge of the upper surface of the rear vent trim is approximately level with the upper surface of the cooking surface, or for example, if at least a part of the upper surface of the rear vent trim is approximately level with the upper surface of the cooking surface. One of ordinary skill in the art will recognize that the upper surface of the rear vent trim, or any part thereof, does not need to be exactly the same height as the upper surface of the cooking surface for the upper surface of the rear vent trim to be substantially flush with the upper surface of the cooking surface.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
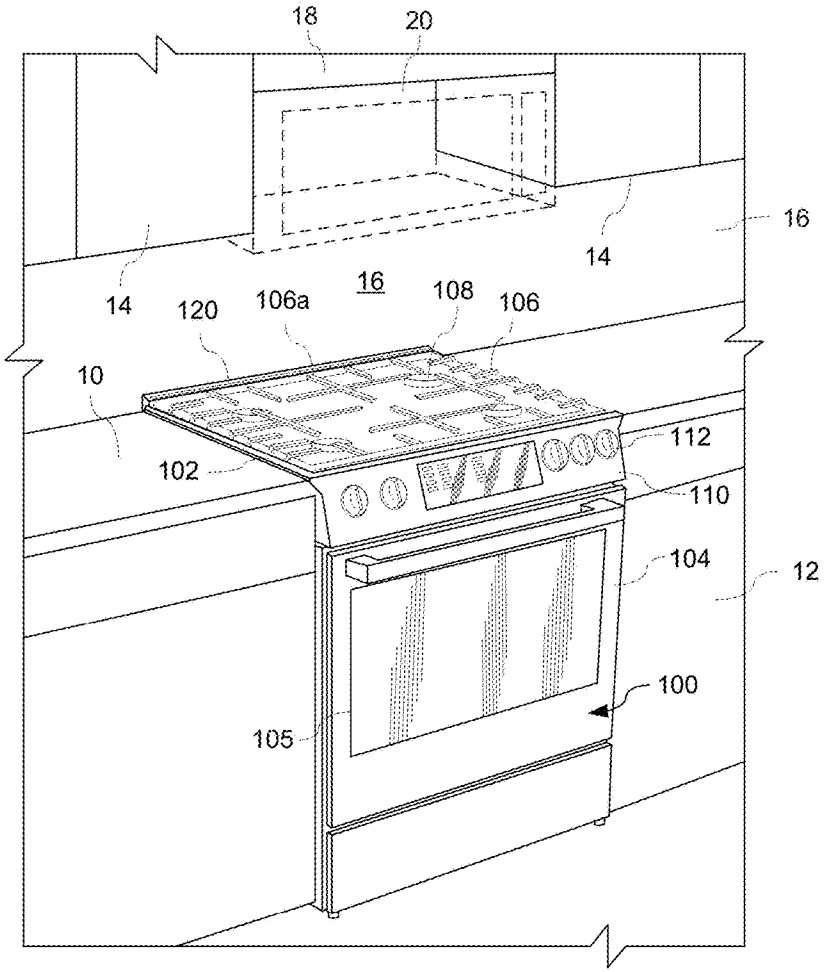
FIG. 1 is a perspective view of a home cooking appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-10B illustrate exemplary embodiments of a home cooking appliance having a rear vent trim.

With reference to FIG. 1, a cooking area of a home kitchen may include counters 10 with floor cabinets 12 below the counters 10. The kitchen can include wall cabinets 14 on back wall 16 (e.g., a combustible back wall). A home cooking appliance 100, such as a slide-in home cooking appliance, can be disposed between the floor cabinets 12 and counters 10. A wall cabinet 18 or an over-the-range (OTR) microwave oven or convention microwave oven 20 can be disposed over the cooking surface 106 of the home cooking appliance 100.

With reference again to FIG. 1, an exemplary embodiment of a home cooking appliance 100 will now be described. The home cooking appliance 100 has a housing 102 with a cooking compartment, such as a baking oven, convection oven, steam oven, warming drawer, etc., in the housing 102 and accessible through a door 104 in a front of the housing 102. The door 104 has a door glass 105. The home cooking appliance 100 has a cooking surface 106 on a top of the housing 102. The cooking surface 106 can include one or more cooking grates having an upper surface 106*a* for supporting cookware over one or more gas burners 108. The appliance 100 includes a control panel 110 having a plurality of control knobs 112 for controlling the operation of the burners 108 and the cooking compartment.

As shown in FIG. 1, the housing 102 can include a rear vent trim 120 on the top of the housing 102 and at a rear side of the cooking surface 106. The rear vent trim 120 can include an upper surface that is substantially flush with the upper surface 106*a* of the rear end of the cooking surface 110, thereby maximizing the cooking area of the appliance and providing a low-profile appearance.

Figure 2:
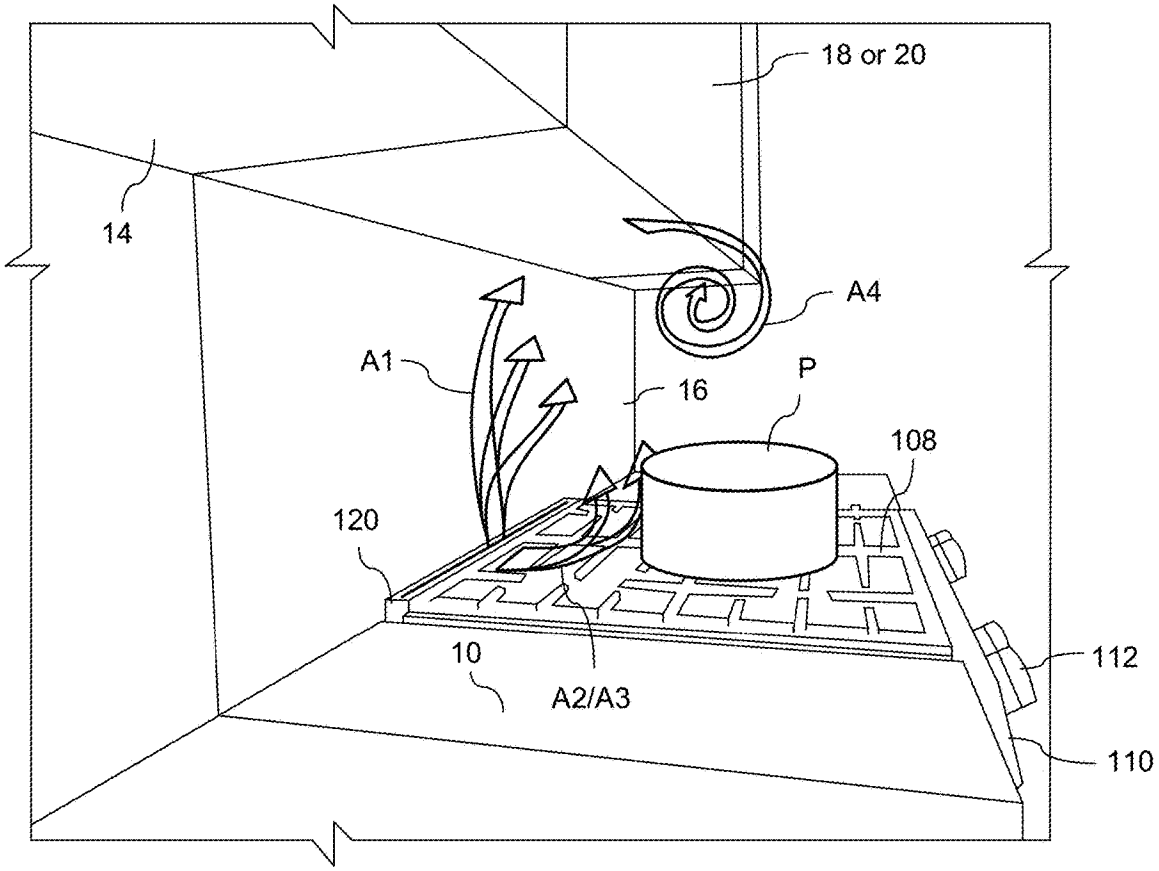
FIG. 2 is a partial, perspective view of a home cooking appliance schematically illustrating air flow patterns according to an exemplary embodiment of the invention.
Figure 3A:
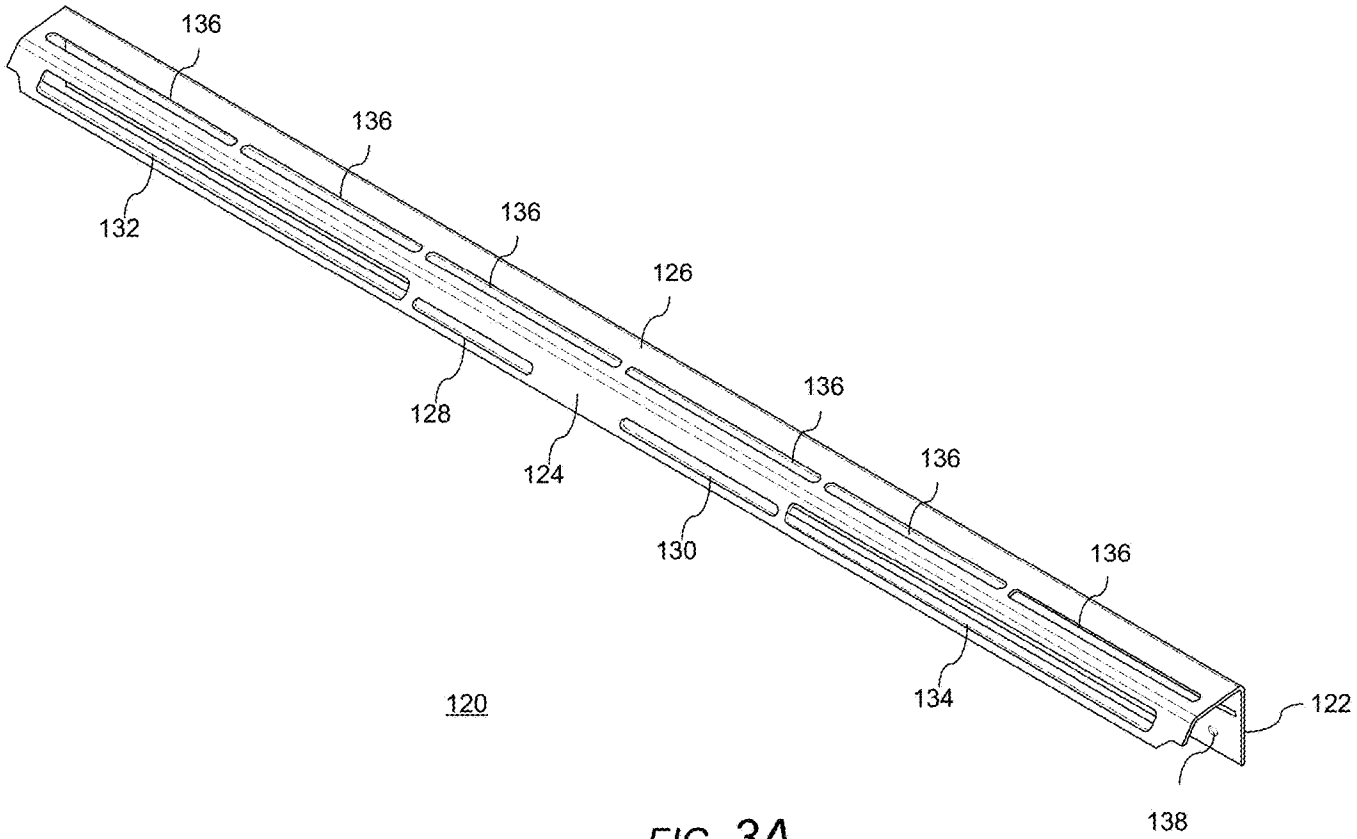
FIG. 3A is a perspective view of a rear vent trim for a home cooking appliance according to an exemplary embodiment of the invention.
Figure 3B:
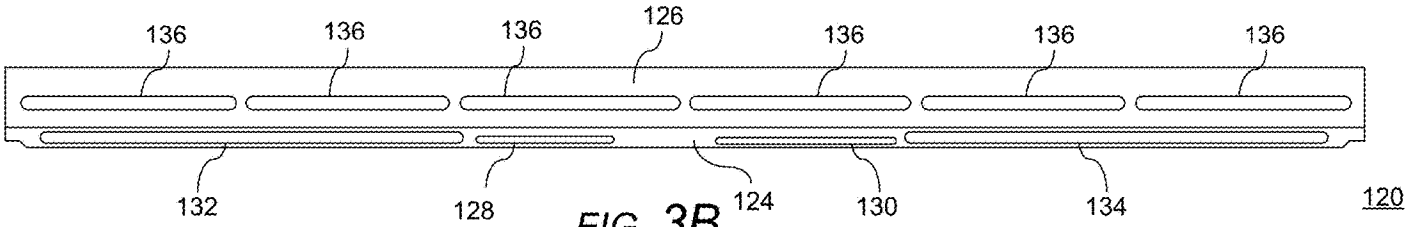
FIG. 3B is a plan view of the rear vent trim according to the exemplary embodiment illustrated in FIG. 3A taken at an angle perpendicular to surface 126 in FIG. 3A.
Figure 3C:
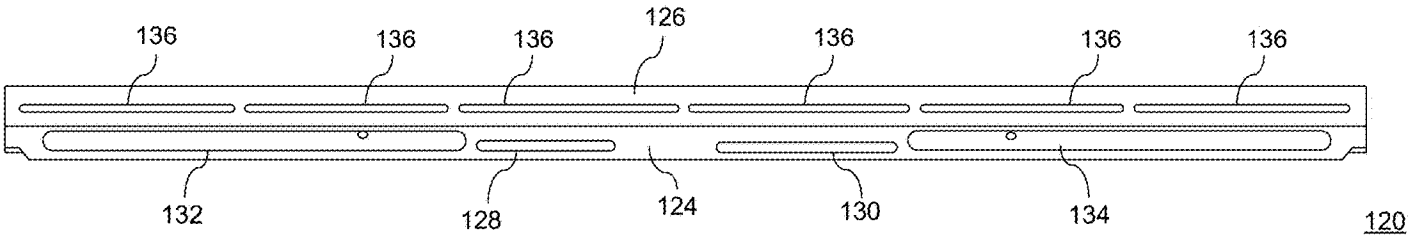
FIG. 3C is a plan view of the rear vent trim according to the exemplary embodiment illustrated in FIG. 3A taken at an angle perpendicular to surface 124 in FIG. 3A.
Figure 3D:
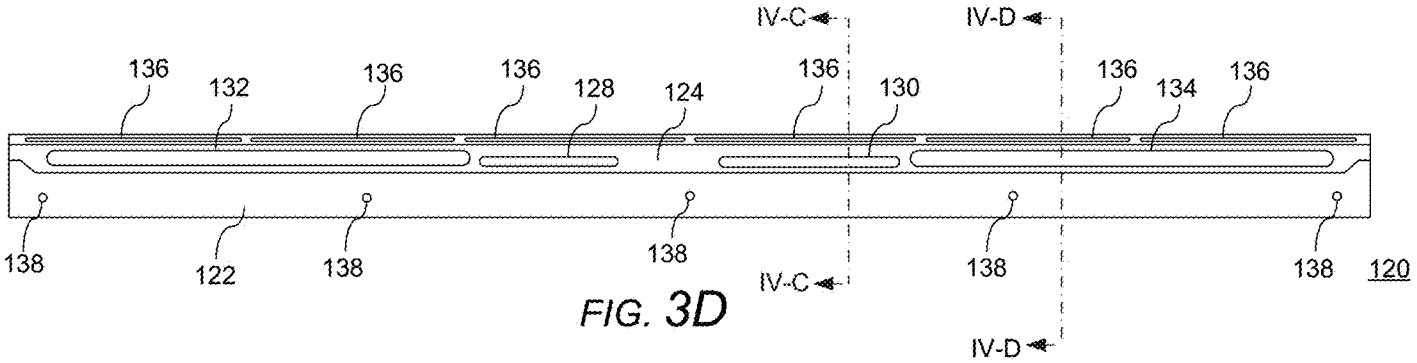
FIG. 3D is a front view of the rear vent trim according to the exemplary embodiment illustrated in FIG. 3A taken at an angle perpendicular to surface 122 in FIG. 3A.

With reference to FIG. 2, the rear vent trim 120 includes one or more openings (which will be explained in greater detail below with reference to FIGS. 3A-4D) for permitting air to exit from within the rear vent trim 120 while directing the air away from the back wall 16 (e.g., away from a 90° angle with respect to the upper surface of the cooking surface), as illustrated by the arrows A1, A2, and/or A3 in FIG. 2. The rear vent trim 120 (and particularly the openings in the rear vent trim) can be arranged in fluid communication with a cavity or duct for exhausting ambient kitchen air (e.g., A1) up and away from the back wall 16, a cavity or duct for exhausting cooling air (e.g., A2) circulated or passed through the appliance (e.g., through the housing 102 and/or door 104 of the appliance 100), and/or one or more flues for exhausting flue gas (e.g., A3) from the cooking compartment (each of which will be explained in greater detail below with reference to FIGS. 4C, 4D, and 6-8).

With reference again to FIG. 2, the rear vent trim 120 controls and manages the air flow by directing the flow of air (e.g., A1, A2, A3) from the rear vent trim 120 forward and away from a combustible back wall 16 of the kitchen (e.g., away from a 90° angle with respect to the upper surface of the cooking surface), thereby minimizing temperatures on the combustible back wall 16 of the kitchen and improving compliance with industry standards and regulations. In an exemplary embodiment, the rear vent trim 120 exhausts the air A1, A2, A3 from different openings in the rear vent trim 120 while directing the air A1, A2, A3 away from the back wall 16. As shown in FIG. 1, the rear vent trim 120 can split the air A1, A2, A3 such that some of the air (e.g., A2, A3 in FIG. 2) flows at an angle away from the back wall 16 and beneath the cooking grates 106, while some of the air (e.g., A1 in FIG. 2) flows at an angle away from the back wall 16 and above the cooking grates 106.

With reference again to FIG. 2, the effect of the rear vent trim 120 on the flow of air over the cooking surface 106 will be described in greater detail. As shown in FIG. 2, an exemplary embodiment of the rear vent trim 120 is configured to provide three air-flow 'zones' for managing airflow over the cooking surface. For example, the rear vent trim 120 includes one or more first openings providing a first zone (Zone 1; shown by A1) in which air comes up from behind the appliance 100, exits the rear vent trim 120 through a first opening or set of openings, and gently blows up and forward to cool the back wall 16. The rear vent trim 120 includes a second opening or set of openings providing a second zone (Zone 2; shown by A2) such that, when the oven is ON and a cooling fan (not shown in FIG. 2; described with reference to FIG. 8) is running, air A2 is gently directed out of the second openings at angles away from the burners 108 such that the air A2 does not disrupt the burner flame even when a burner 108 is on a lowest setting. The air A2 from the second zone works in combination with the air A1 from the first zone to gently spin the combined air flow A4 up in a vortex away from the back wall and upper cabinets, for example, like a reverse-Coanda effect. The rear vent trim 120 includes a third opening or set of openings in communication with one or more oven flues (not shown in FIG. 2) to provide a third zone (Zone 3; shown by A3) such that hot air/flue gas (oven combustion) flows up from the gas cooking compartment, exits the third openings of the rear vent trim 120 in a direction away from the back wall 16, and gently wisps out onto the cooktop spill tray on the top of the housing 102. The hot air/flue gas A3 of the third zone moves into the air-stream A4 created by the first zone A1 and the second zone A2 and away from the back wall 16 and upper cabinets 18 (or components 20 such as an OTR microwave). In a particular example, the rear vent trim 120 directs the air A1 of the first zone away from the back wall 16 and above the cooking grates 106, while directing the both the cooling air A2 and the hot air/flue gas A3 of the second zone and the third zone away from the back wall 16 and beneath the cooking grates 106.

With reference to FIGS. 3A-3D, an exemplary embodiment of a rear vent trim 120 will now be described. As shown in FIG. 3, the rear vent trim 120 includes a rear facing mounting surface 122, which is arranged to be coupled to the housing 102 of the appliance, for example, using one or more screw holes 138. In the example, the rear vent trim 120 has two upper surfaces: a first upper surface 126 and a second upper surface 124. The second upper surface 124 is arranged at an angle with respect to the first upper surface 126 and is angled by a greater amount toward a front of the appliance 100 than the first upper surface 136. In other embodiments, the rear vent trim 120 can have a single upper surface.

The first upper surface 126 includes one or more openings 136 for permitting air to exit from within the rear vent trim 120. As shown in FIGS. 3A-3D, the openings 136 can be different sizes in order to optimize the air flow through the openings and the resulting heat management. For example, in the illustrated example, the dimensions (e.g., the length and cross-sectional area) of several of the openings 136 vary from the others along the length of the rear vent trim 120. The dimensions of the openings 136 are not limited to the illustrated example and can have different dimensions (e.g., a different length, width, cross-sectional area, radius of curvature of the ends of the openings, etc.) in order to optimize the air flow through the openings and the resulting heat management. In other embodiments, all of the openings 136 can have the same dimensions (e.g., the same length, thickness, cross-sectional area). The openings 136 can be arranged in fluid communication with the same air source or with one or more different air sources. For example, the openings 128 and 130 can be coupled to a duct conveying a cooling air through the appliance. In this example, the dimensions of the openings 128 and 130 can be different even thought they are arranged in communication with the same air source in order to optimize the air flow. In other embodiments, the dimensions of the openings 128 and 130 can be the same. Similarly, in another example, the openings 132 and 134 can be coupled to one or more flues for exhausting flue gases from the appliance. In this example, the dimensions of the openings 132 and 134 can be different even thought they are arranged in communication with the same air source in order to optimize the air flow. In other embodiments, the dimensions of the openings 132 and 134 can be the same. In other embodiments, the rear vent trim 120 can have a single upper surface including one or more of the openings 128, 130, 132, 134, 136.

With reference again to FIGS. 3A-3D, the second upper surface 124 also includes one or more openings 128, 130, 132, 134 for permitting air to exit from within the rear vent trim 120. As shown in FIGS. 3A-3D, the openings 128, 130, 132, 134 can be different sizes in order to optimize the air flow through the openings and the resulting heat management, for example, depending on the type, temperature, and velocity of the air exiting the openings 128, 130, 132, 134. For example, in the illustrated example, the dimensions (e.g., length, width, cross-sectional area, radius of curvature of the ends of the openings, etc.) of the openings 128, 130, 132, 134 varies depending on a location along the length of the rear vent trim 120. The dimensions of the openings 128, 130, 132, 134 are not limited to the illustrated example and can have different dimensions (e.g., a different length, width, cross-sectional area, radius of curvature of the ends of the openings, etc.) in order to optimize the air flow through the openings and the resulting heat management. In other embodiments, all of the openings 128, 130, 132, 134 can have the same dimensions (e.g., the same length, width, cross-sectional area, radius of curvature of the ends of the openings, etc.). The openings 128, 130, 132, 134 can be arranged in fluid communication with the same air source or with one or more different air sources.

Figure 4B:
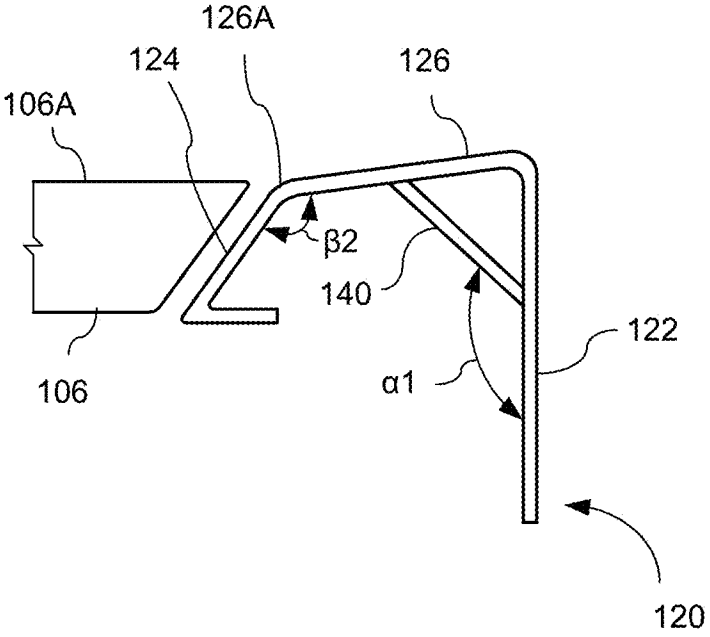
FIG. 4B is a side view of the rear vent trim according to the exemplary embodiment illustrated in FIGS. 3A-3D.
Figure 4A:
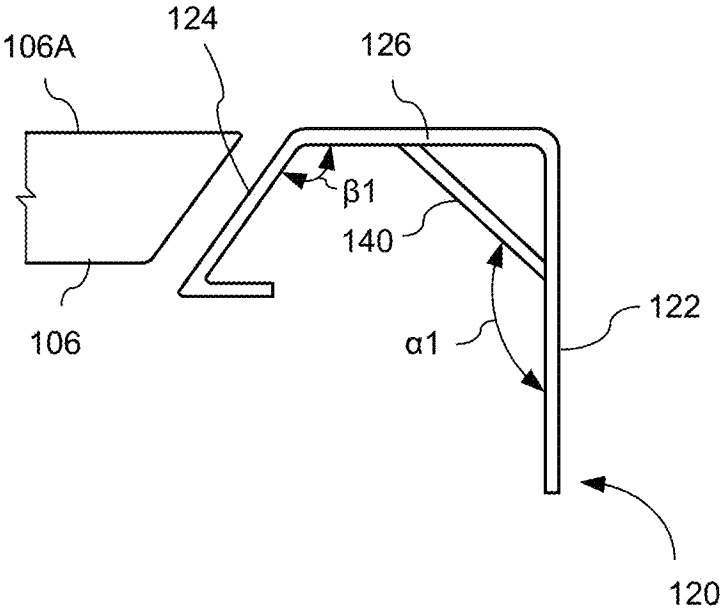
FIG. 4A is a side view of a rear vent trim for a home cooking appliance according to an exemplary embodiment of the invention.

With reference to FIGS. 4A and 4B, in order to provide a low-profile appearance and maximize the cooking area, the upper surface 126 of the rear vent trim 120 is substantially flush with the upper surface 106*a* of the cooking surface (e.g., cooking grates 106). As shown in FIG. 4A, the upper surface 126 of the rear vent trim 120 can be substantially level, and more particularly coplanar, with the upper surface 106*a* of the cooking surface 106. However, the upper surface 126 of the rear vent trim 120 does not need to be level or coplanar with the upper surface 106*a* of the cooking surface 106, as shown in FIG. 4A, to be substantially flush with the upper surface 106*a* of the cooking surface 106 within the spirit and scope of the invention. For example, as shown in FIG. 4B, the upper surface 126 of the rear vent trim 120 is substantially flush with the upper surface 106*a* of the cooking surface 106 if at least the front edge 126*a* of the upper surface 126 of the rear vent trim 120 is approximately level with the upper surface 106*a* of the cooking surface 106. One of ordinary skill in the art will recognize that the upper surface 126 (or the front edge 126*a* of the rear vent trim 120 or the rear edge (not labeled) of the rear vent trim 120) can be slightly higher or lower than the upper surface 106*a* of the cooking surface 106 while still providing a substantially flush arrangement having a low-profile appearance and that maximizes the cooking area of the appliance within the spirit and scope of the invention. However, the upper surface 126 of the rear vent trim 120, or any part thereof, does not need to be exactly the same height as the upper surface 106*a* of the cooking surface 106 for the upper surface 126 of the rear vent trim 120 to be substantially flush with the upper surface 106*a* of the cooking surface 106.

Figure 4D:
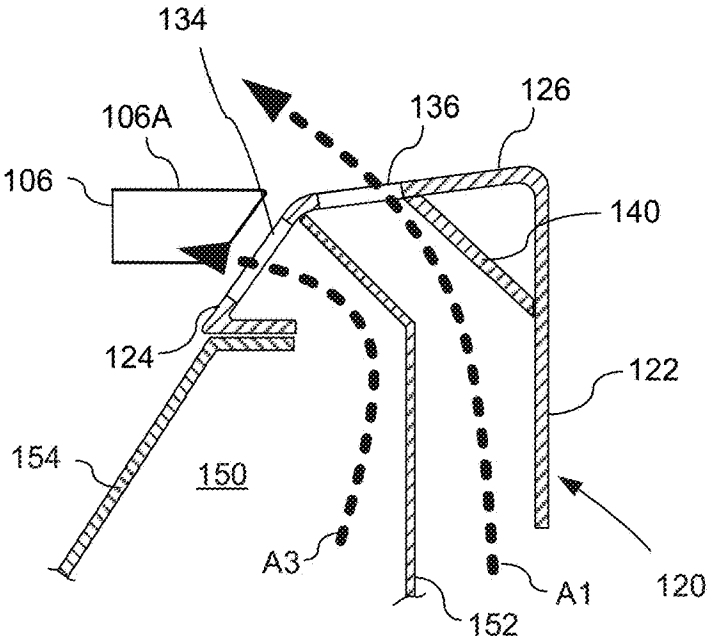
FIG. 4D is a cross-sectional view of the rear vent trim according to the exemplary embodiment illustrated in FIG. 3D taken along section IV-D.
Figure 4C:
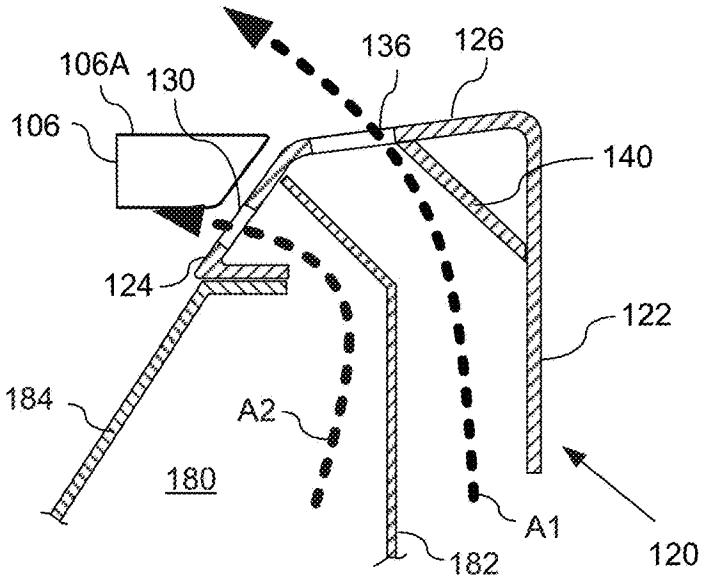
FIG. 4C is a cross-sectional view of the rear vent trim according to the exemplary embodiment illustrated in FIG. 3D taken along section IV-C.

With reference to FIG. 4B, and also to FIGS. 4C and 4D, the upper surface 126 can be sloped or angled slightly with respect to the upper surface 106*a* of the cooking surface 106, for example, to permit the air to flow more easily away from a 90° angle with respect to the upper surface 106*a* of the cooking surface 106 as the air exits the opening 136 (in FIGS. 4C and 4D). As shown in the examples of FIGS. 4A and 4B, the second upper surface 124 can be arranged at an angle (e.g., β1, β2) with respect to the first upper surface 126, and if the first upper surface 126 also is angled, then the second upper surface 124 can be angled by a greater degree toward a front of the appliance 100 than the first upper surface 126. In this way, the second upper surface 124 permits air to flow more easily away from a 90° angle with respect to the upper surface 106*a* of the cooking surface 106 as the air exits the openings 130, 134 (and also 128, 132), and also permits the air A2, A3 to flow more easily under the cooking surface 106 (as shown in FIGS. 4C, 4D).

In another exemplary embodiment (not shown), the rear vent trim 120 can have a single upper surface. In this example, the single upper surface can be angled toward a front of the appliance 100 to permit air to flow more easily away from a 90° angle with respect to the upper surface 106*a* of the cooking surface 106 as the air exits the openings 130, 134 (and also 128, 132), and also to permit the air A2, A3 to flow more easily under the cooking surface 106.

With reference to FIGS. 4A-4D, the rear vent trim 120 can include a deflector 140 that directs the air A1 away from the 90° angle with respect to the upper surface 106*a* of the cooking surface 106 and through the opening 136 in the rear vent trim 120. The deflector 140 is arranged at an angle (e.g., al) with respect to the vertical wall 122 of the rear vent trim 120.

As shown in FIG. 4C, the air A2 flows through a second channel 180 to a second opening 130 and can be directed away from a 90° angle with respect to the upper surface 106*a* of the cooking surface 106 by a part 182 of the second air channel 180 (e.g., cooling air channel) before exiting the second opening 130. Alternatively, the rear vent trim 120 can include a second deflector (not shown), which is integrally formed with the rear vent trim 120 and which directs the air A2 away from a 90° angle with respect to the upper surface of the cooking surface and through the second opening 130. In another example, the second opening 130 can include a surface that directs the air A2 away from a 90° angle with respect to the upper surface 106*a* of the cooking surface 106 as the air A2 passes through the second opening 130.

Similarly, as shown in FIG. 4D, the air A3 flowing through a third channel 150 (e.g., oven flue) to a third opening 134 can be directed away from a 90° angle with respect to the upper surface 106*a* of the cooking surface 106 by a part 152 of the third channel 150 before exiting the third opening 134. Alternatively, the rear vent trim 120 can include a third deflector (not shown), which is integrally formed with the rear vent trim 120 and which directs the air A3 away from a 90° angle with respect to the upper surface 106*a* of the cooking surface 106 and through the third opening 134. In another example, the third opening 134 can include a surface that directs the air A3 away from a 90° angle with respect to the upper surface of the cooking surface as the air passes through the third opening.

With reference again to FIGS. 4C and 4D, the opening 136 of the rear vent trim 120 can be arranged in fluid communication with a cavity or duct for exhausting ambient kitchen air (e.g., A1) up and away from the back wall 16. The opening 130 can be arranged in fluid communication with a cavity or duct 180 for exhausting cooling air (e.g., A2) circulated or passed through the appliance (e.g., through the housing 102 and/or door 104 of the appliance 100). The opening 134 can be arranged in fluid communication with one or more flues for exhausting flue gas (e.g., A3) from the cooking compartment. The rear vent trim 120 controls and manages the air flow above the cooking surface 106 by directing the flow of air (e.g., A1, A2, A3) from the rear vent trim 120 forward and away from a combustible back wall 16 of the kitchen (e.g., away from a 90° angle with respect to the upper surface of the cooking surface), thereby minimizing temperatures on the combustible back wall 16 of the kitchen and improving compliance with industry standards and regulations. As shown in FIGS. 4C and 4D, the rear vent trim 120 can split the air A1, A2, A3 such that some of the air (e.g., A2, A3) flows at an angle away from the back wall 16 and beneath the cooking grates 106, while some of the air (e.g., A1) flows at an angle away from the back wall 16 and above the cooking grates 106. As explained above with reference to FIG. 2, the air A1 exits the rear vent trim 120 through the first opening 136 or set of openings 136, and gently blows up and forward to cool the back wall 16. When the oven is ON and a cooling fan (described with reference to FIG. 8) is running, the air A2 is gently directed out of the second opening 130 or set of openings 130 under the cooking grate 106 and at an angle away from the burners 108 such that the air A2 does not disrupt the burner flame even when a burner 108 is on a lowest setting. The air A2 works in combination with the air A1 to gently spin the combined air flow up in a vortex away from the back wall and upper cabinets, for example, like a reverse-Coanda effect (as described with reference to FIG. 2 above). Additionally, the hot air/flue gas (oven combustion) A3 flows up from the gas cooking compartment, exits the third opening 134 or set of third openings 134 of the rear vent trim 120 in a direction under the cooking grate 106 and at an angle away from the burners 108 such that the air A2 does not disrupt the burner flame even when a burner 108 is on a lowest setting, and gently wisps out onto the cooktop spill tray on the top of the housing 102. The hot air/flue gas A3 moves into the air-stream created by the air A1 and the air A2 and away from the back wall 16 and upper cabinets 18 (or components 20 such as an OTR microwave), as shown in FIG. 2.

Figure 5A:
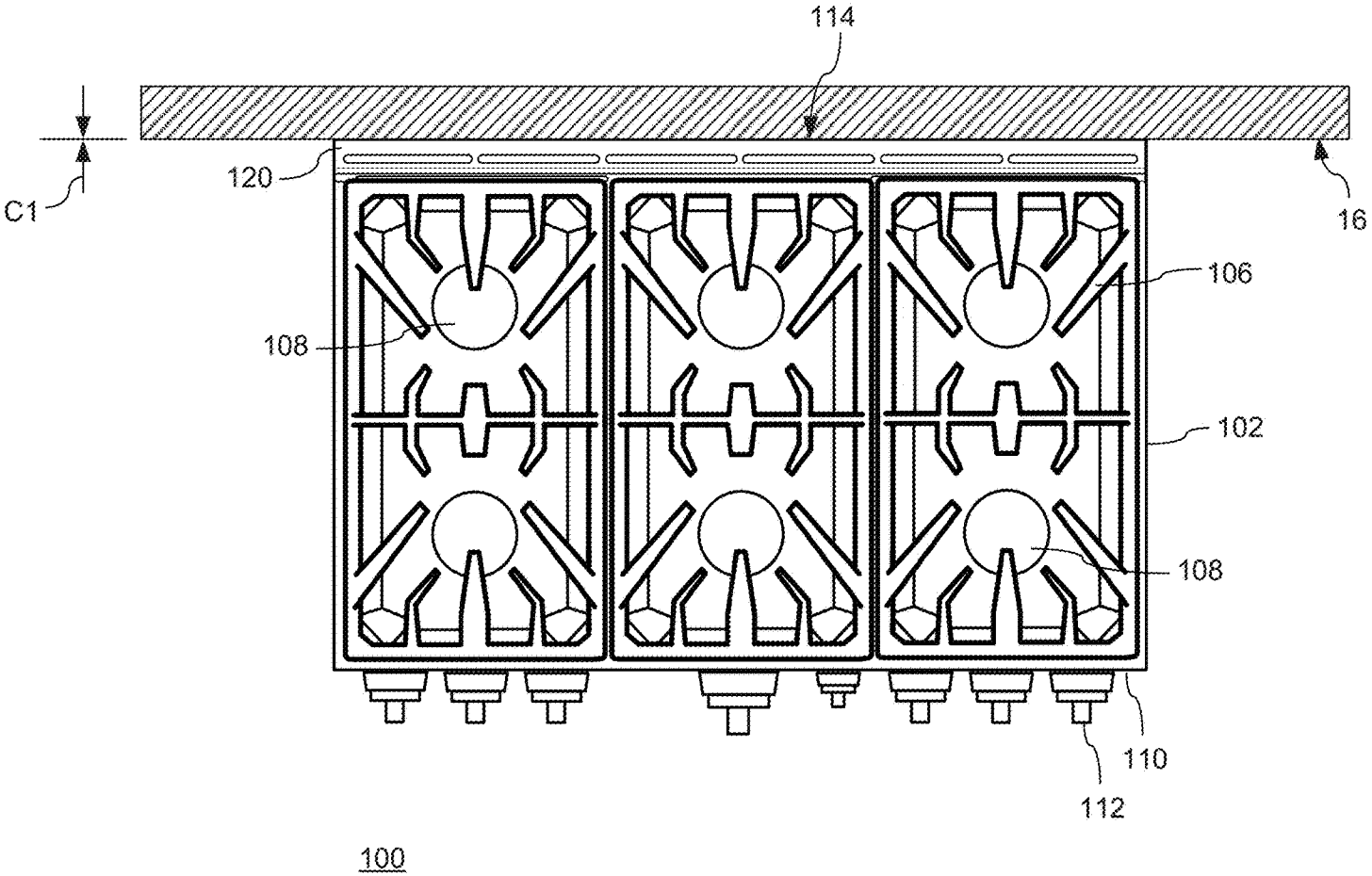
FIG. 5A is a top view of a home cooking appliance according to an exemplary embodiment of the invention.

With reference to FIG. 5A, the rear vent trim 120 controls and manages the air flow above the cooking surface 106, thereby minimizing temperatures on the combustible back wall 16 of the kitchen and improving compliance with industry standards and regulations, while also maintaining passing combustion results at the gas burners 108 and the cooking compartment, minimizing noise to the user, and providing a low profile, rear vent trim 120 that is substantially flush with cooking grates 106 of the home cooking appliance 100. As a result, the present invention can minimize or eliminate a required minimum clearance C1 (shown in FIG. 5A) between the rear wall 114 of the appliance 100 and a combustible back wall 16 of the kitchen, which faces the rear wall 114 of the appliance, while maintaining compliance with industry standards and regulations. In an exemplary embodiment, the rear vent trim 120 controls and manages the air flow to such an extent that the required minimum clearance C1 between the rear wall of the appliance and the combustible back wall 16 of the kitchen is approximately 3 mm, while maintaining compliance with industry standards and regulations. In another exemplary embodiment, the rear vent trim 120 controls and manages the air flow to such an extent that any need for a required clearance between the rear wall 114 of the appliance 100 and the combustible back wall 16 of the kitchen can be entirely eliminated, thereby permitting the rear wall 114 of the appliance to directly abut or contact the combustible back wall 16 of the kitchen, while maintaining compliance with industry standards and regulations.

Figure 5B:
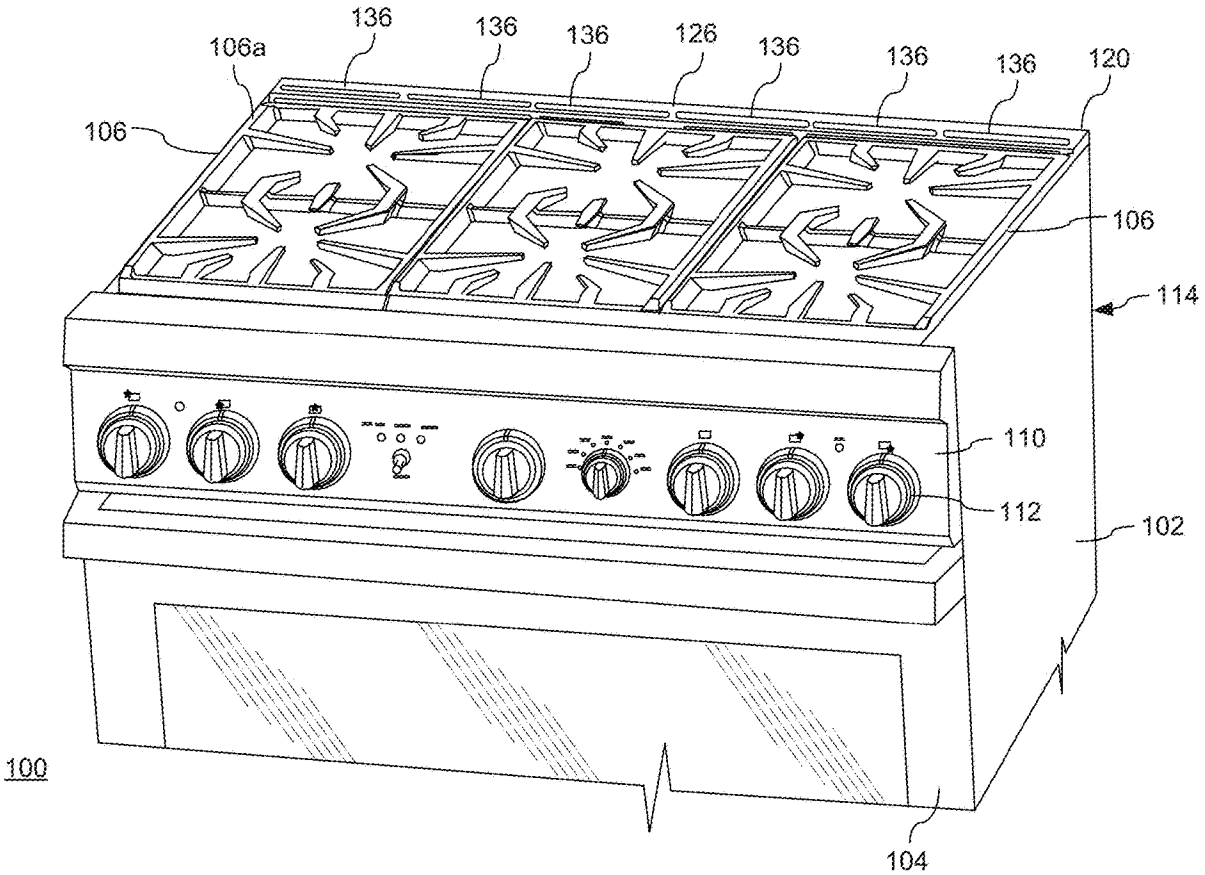
FIG. 5B is a partial, perspective view of a home cooking appliance according to an exemplary embodiment of the invention.

FIG. 5B illustrates an exemplary embodiment of a home cooking appliance 100 having a rear vent trim 120 that is substantially flush with an upper surface 106*a* of the rear side of the cooking surface 106, thereby providing a low-profile and compact appliance that provides a "built-in" appearance that is desirable to a user, while at the same time, controlling and managing the air flow to minimize temperatures on the combustible back wall 16 of the kitchen and to improve compliance with industry standards and regulations, while also maintaining passing combustion results at the gas burners 108 and minimizing noise to the user. As shown in FIG. 5B, the openings 136 are visible in the upper surface 126 of the rear vent trim and direct the air A1 over the cooking grates 106. The openings 128, 130, 132, 134 are concealed from view in FIG. 5B by the cooking grates 106. The openings 128, 130, 132, 134 direct the air A2, A3 beneath the cooking grates 106. In an exemplary embodiment, the cooking surface 106 (e.g., cooking grate) can include one or more slots (e.g., grate slots) corresponding to one or more of the openings 128, 130, 132, 134 and formed in a lower side of a part of the cooking surface 106 to permit the air A2, A3 exiting from the respective openings 128, 130, 132, 134 to pass under the cooking surface 106, for example, with minimal or no interference or disruption to the air flow.

With reference to FIGS. 6-9, an exemplary embodiment of a home cooking appliance having a rear vent trim 120 will now be described to show an example arrangement of the openings 128, 130, 134, 136 of the rear vent trim 120. The cooking surface 106, the cooktop drip tray, and several of the burners 108 have been omitted in FIG. 6 to show the arrangement of air channels within the appliance and which are in fluid communication with the openings 128, 130, 134, 136 of the rear vent trim 120.

Figure 6:
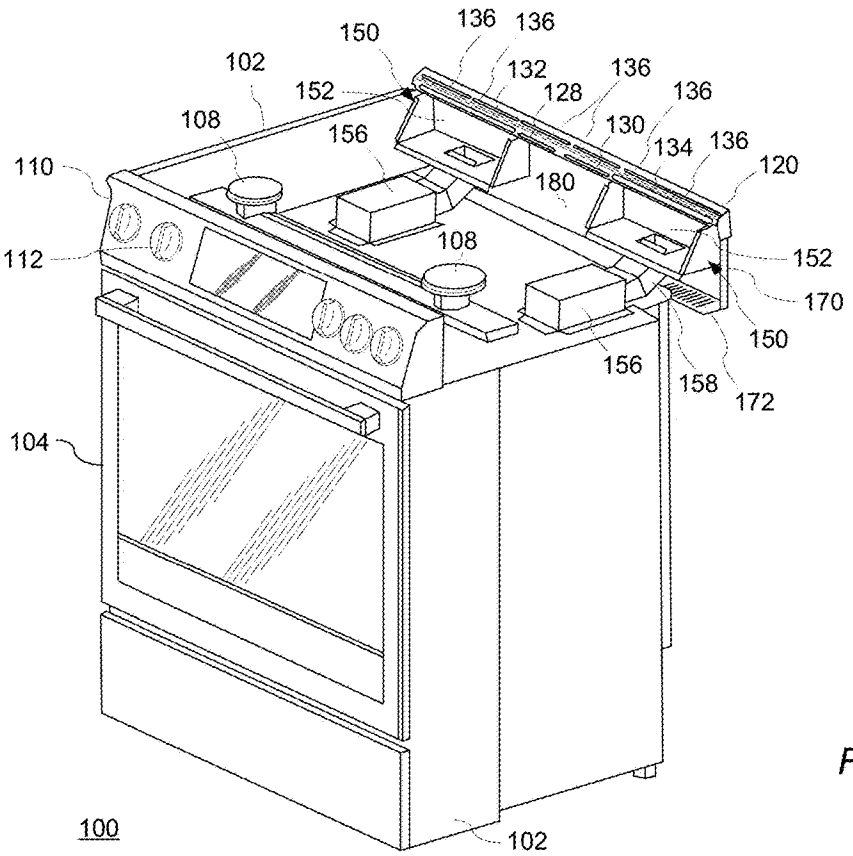
FIG. 6 is a partial perspective view of a home cooking appliance according to an exemplary embodiment of the invention.
Figure 7:
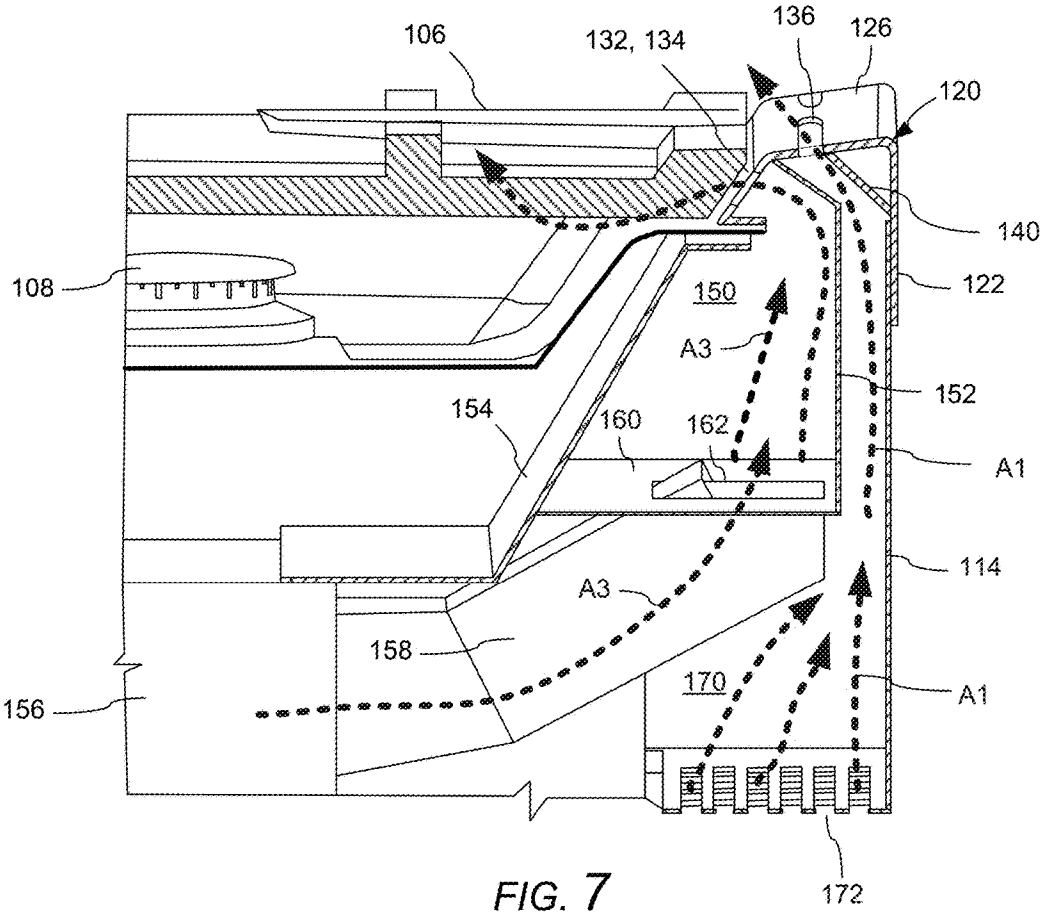
FIG. 7 is a partial cross-sectional view of a home cooking appliance according to an exemplary embodiment of the invention.
Figure 8:
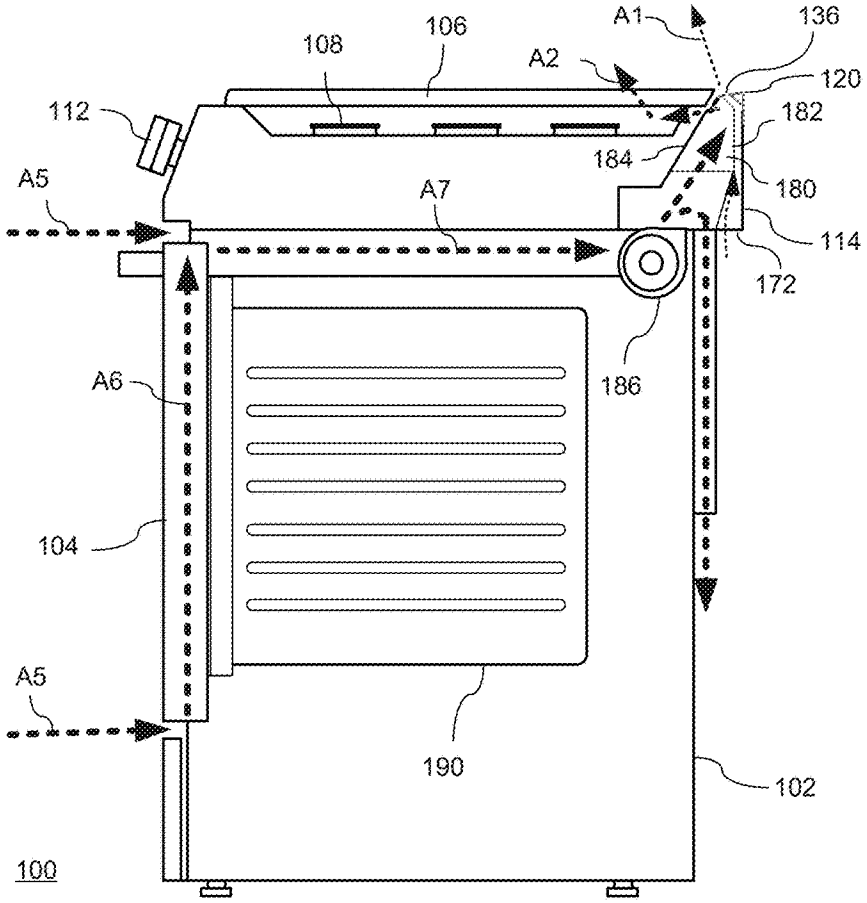
FIG. 8 is a schematic, cross-sectional view of a home cooking appliance according to an exemplary embodiment of the invention taken along a center line of the appliance.

As shown in FIGS. 6-8, the rear vent trim 120 is arranged at a rear side of the top of the appliance 100. The openings 136 extend along the entire length of the rear vent trim 120 and are arranged in fluid communication with a cavity or duct 170 through which cool ambient kitchen air (e.g., A1) is drawn in via entry openings 172. That is, the present invention takes advantage of the heated walls of the flue 150 (e.g., walls 152, 154) to cause the cool ambient kitchen air to be drawn in through the openings 172 by convection.

As shown in FIGS. 6 and 8, the rear vent trim 120 includes a pair of openings 130 arranged at the middle-front of the vent trim above, and in fluid communication with, a cavity or duct 180 for exhausting cooling air (e.g., A2) circulated or passed through the appliance (e.g., through the housing 102 and/or door 104 of the appliance 100) by a fan 186. More particularly, the fan 186 draws cool ambient kitchen air A5 into the housing 102 and/or door 104 of the appliance 100. The air flows through the door 104 along flow path A6 and through the housing 102 along flow path A7 such that heat is transferred to the air for cooling the components of the appliance 100. The fan 186 draws the air through the appliance and then pushes the heated air A2 through the cavity 180, which is defined in part by walls 182 and 184, and out of the rear vent trim 120 via openings 128, 130.

As shown in FIGS. 6 and 7, the rear vent trim 120 includes a pair of openings 132, 134 arranged at opposites ends of the rear vent trim 120 above a pair of separate flue boundaries 150, which are defined in part by walls 152, 154, and 160. The appliance 100 includes a pair of flues 156 for exhausting flue gases from the cooking compartment (190 shown in FIG. 8). The flues 156 are in fluid communication with ducts 158 (shown in FIG. 7), which exit into the flue boundary 150 via openings 162 formed in the floor 160 of the flue boundary.

The rear vent trim 120 includes a pair of openings 132, 134 arranged in fluid communication with the pair of separate flue boundaries 150 such that the flue gas (e.g., A3) can be exhausted from the cooking compartment 190 (shown in FIG. 8) via the openings 132, 134. As shown in FIG. 7, the air A3 flows up from the flue 156 via the duct 158 into the cavity 150, where it is directed by the wall 152 at an angle away from a 90° angle with respect to the upper surface 106*a* of the cooking surface 106 and through the opening 132, 134 in the rear vent trim 120 in a direction, for example, under the cooking grate 106 and at an angle away from the burners 108 such that the air A3 does not disrupt the burner flame even when a burner 108 is on a lowest setting, and gently wisps out onto the cooktop spill tray on the top of the housing 102. As explained above, in an exemplary embodiment, the cooking surface 106 (e.g., cooking grate) can include one or more slots (e.g., grate slots) corresponding to one or more of the openings 128, 130, 132, 134 and formed in a lower side of a part of the cooking surface 106 to permit the air A2, A3 exiting from the respective openings 128, 130, 132, 134 to pass under the cooking surface 106, for example, with minimal or no interference or disruption to the air flow.

FIGS. 9A-9D illustrate thermal imaging showing a comparison between a conventional appliance and an exemplary appliance having the features of the present invention. The thermal imaging illustrates higher temperatures using lighter shades, and illustrates lower temperatures in darker shades. The thermal imaging has been annotated to identify the features of the appliance and the surrounding environment of the kitchen.

Figure 9B:
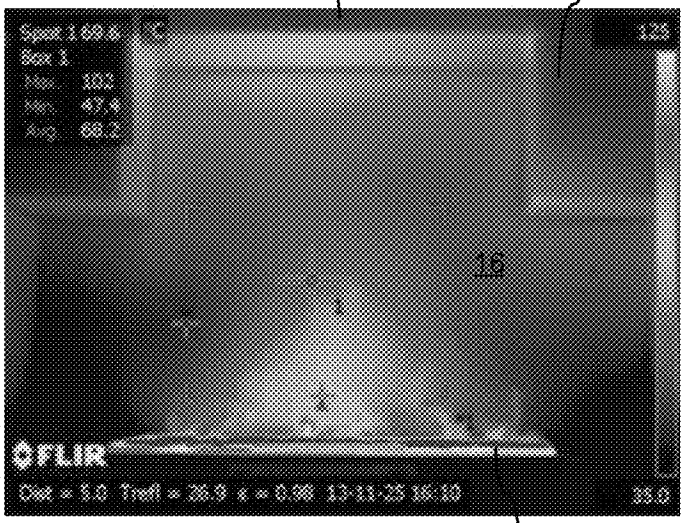
FIG. 9B is a schematic view illustrating test results of measured temperatures on a back wall and adjacent cabinetry of a kitchen over an unoccupied cooking surface of a home cooking appliance according to an exemplary embodiment of the invention.
Figure 9A:
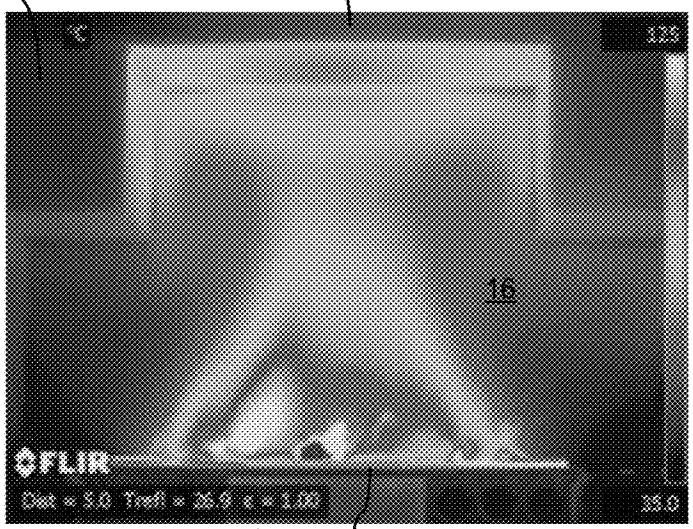
FIG. 9A (CONVENTIONAL ART)
FIG. 9A is a schematic view illustrating test results of measured temperatures on a back wall and adjacent cabinetry of a kitchen over an unoccupied cooking surface of a conventional home cooking appliance.
Figure 9D:
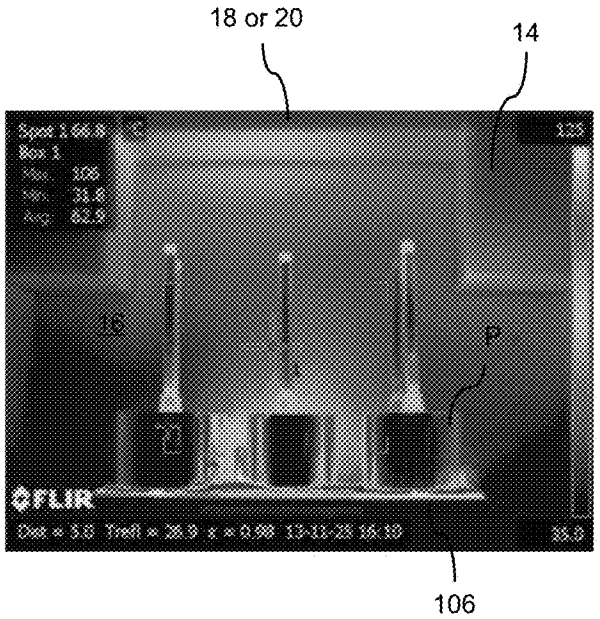
FIG. 9D is a schematic view illustrating test results of measured temperatures on a back wall and adjacent cabinetry of a kitchen over an occupied cooking surface of a home cooking appliance according to an exemplary embodiment of the invention.
Figure 9C:
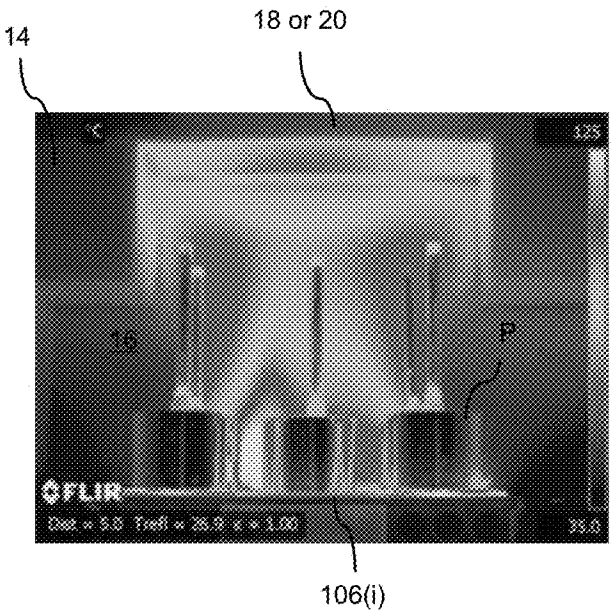
FIG. 9C (CONVENTIONAL ART)
FIG. 9C is a schematic view illustrating test results of measured temperatures on a back wall and adjacent cabinetry of a kitchen over an occupied cooking surface of a conventional home cooking appliance.

Particularly, FIGS. 9A and 9C illustrate thermal imaging of a cooking area above a cooking surface 106(*i*) of a conventional appliance along with the back wall 16 and cabinetry (e.g., 14, 18, 20) of a kitchen. FIG. 9C illustrates special heat-sink pots P with water used for testing purposes. For testing purposes, the conventional appliance was operated with the burners on 80% of full power and the oven was operated for an hour. As shown in FIGS. 9A and 9C, the tests resulted in potentially dangerously high temperatures at the back wall 16 and over-the-range cabinetry (e.g., 14, 18, 20), which may exceed prescribed acceptable limits for industry standards and regulations.

In comparison, FIGS. 9B and 9D illustrate thermal imaging showing a cooking area of an exemplary appliance (e.g., 100 in FIG. 1) having the features of the flue boundary 150, the cooling rough-in box 170, and the rear vent trim 120 according to the present invention, along with the back wall 14 and cabinetry (e.g., 14, 18, 20) of a kitchen. For testing purposes, the exemplary appliance also was operated with the burners on 80% of full power and the oven was operated for an hour. FIG. 9D illustrates special heat-sink pots P with water used for testing purposes of the exemplary appliance. As shown in FIGS. 9B and 9D, the tests resulted in a significant reduction in temperatures at the back wall 14 and over-the-range cabinetry (e.g., 14, 18, 20) compared to the conventional appliance. As a result, the exemplary appliance was able to maintain temperatures below the prescribed limits for industry standards and regulations.

Figure 10A:
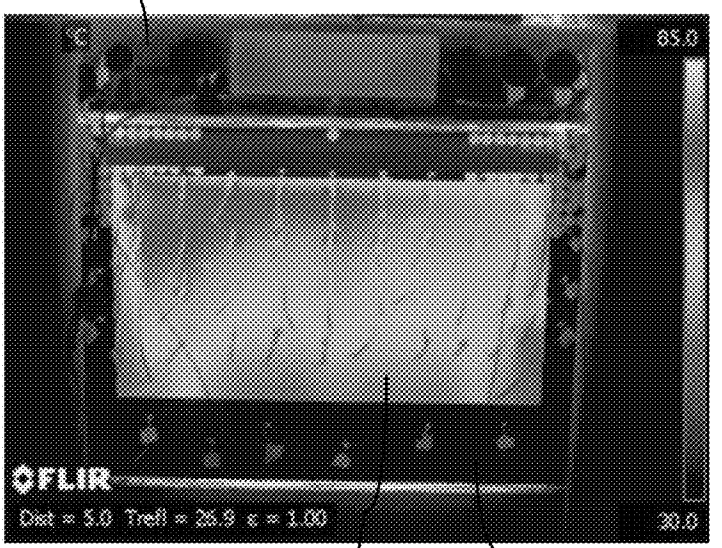
FIG. 10A (CONVENTIONAL ART)
FIG. 10A is a schematic view illustrating test results of measured temperatures on a door of a conventional home cooking appliance.
Figure 10B:
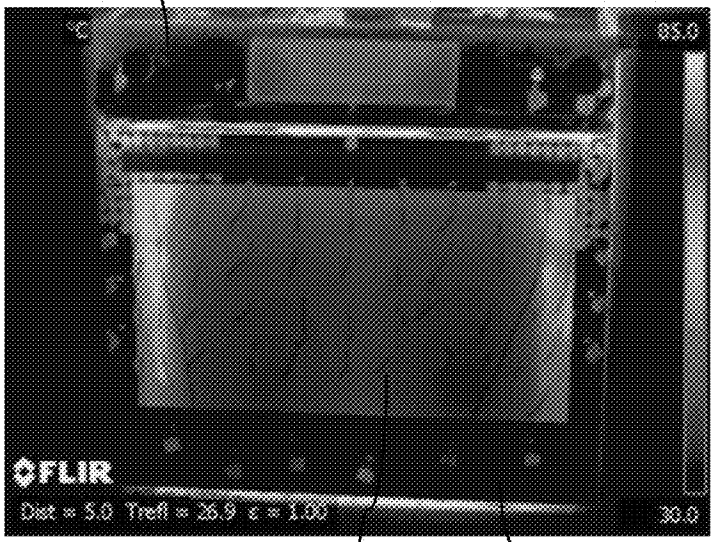
FIG. 10B is a schematic view illustrating test results of measured temperatures on a door of a home cooking appliance according to an exemplary embodiment of the invention.

FIGS. 10A-10B illustrate thermal imaging showing a comparison between a glass oven door 104(*i*) of a conventional appliance and a glass oven door 104 of an exemplary appliance having the features of the present invention. The thermal imaging illustrates higher temperatures using lighter shades, and illustrates lower temperatures in darker shades. The thermal imaging has been annotated to identify the features of the appliance and the surrounding environment of the kitchen.

Particularly, FIG. 10A illustrates thermal imaging of a glass oven door 104(*i*) having door glass 105(*i*) of a conventional appliance where a self-clean cycle of the oven was performed. As shown in FIG. 10A, the tests resulted in potentially dangerously high temperatures at the glass oven door 104(*i*) and door glass 105(*i*), which may exceed prescribed acceptable limits for industry standards and regulations.

In comparison, FIG. 10B illustrates thermal imaging showing a glass oven door 104 having door glass 105 of an exemplary appliance having the features of the flue boundary 150, the cooling rough-in box 170, and the rear vent trim 120 according to the present invention where a self-clean cycle of the oven was performed. As shown in FIG. 10B, the tests resulted in a significant reduction in temperatures at the glass oven door 104 and the door glass 105 compared to the conventional appliance. As a result, the exemplary appliance was able to maintain temperatures below the prescribed limits for industry standards and regulations.

With reference again to FIGS. 1-8, the rear vent trim 120 can be formed, for example, from extruded aluminum. The rear vent trim 120 includes an angled corner to reduce turbulence and direct air forward away from a back wall 16 of the kitchen. The rear vent trim 120 enables the appliance to provide wall temperatures and component temperatures, while maintaining passing combustion results, for example, at the burners 108 and cooking compartment 190 (FIG. 7). More particularly, in testing, an exemplary appliance including the rear vent trim 120 maintained good combustion within the cooking compartment while reducing back wall temperatures by as much 30-60° C. and glass oven door temperatures by as much 30° C.

The exemplary embodiments provide important advantages in that an appliance having the rear vent trim 120 is ready to be pushed up against any composition back wall as-is such that a user can install the appliance with zero clearance to a combustible wall and/or under an over-the-range cabinet or component, such as an OTR microwave, without any required modifications to the kitchen cabinets, back wall, or countertops. The rear vent trim 120 manages and controls the flow of hot air to minimize temperatures at the back wall as well as at the glass oven door and electronic controls of the appliance. Moreover, the rear vent trim 120 splits the air exhausted from the appliance such that there is not a singular hot air extraction/collection point.

Other advantages of the exemplary rear vent trim 120 are that it does not blow hot air at a user, allows the burners to function effectively even at lowest settings (without nuisance clicking), allows installation of the appliance with an OTR component (such as an OTR microwave), allows installation of the appliance with a combustible rear wall, and maintains safe door temperatures and electronic component temperatures, even during self clean cycles, particularly when used in combination with other temperature control measures of the exemplary home cooking appliance. By effectively managing and controlling the flow of hot air, the exemplary appliance having the rear vent trim 120 can assist with balancing and optimizing the air flow in the cooking compartment, thereby resulting in improved baking results for the oven. Moreover, by effectively managing and controlling the flow of hot air, the exemplary appliance having the rear vent trim 120 enables a low-profile rear vent trim having a flush installation with the cooking surface to be used with a high power cooktop (e.g., 60000 BTU/Hr) while complying with industry standards and regulations.

To summarize, an exemplary embodiment is directed to a home cooking appliance 100 comprising a housing 102, a cooking surface 106 on a top of the housing 102, the cooking surface 106 having an upper surface 106*a*, and a rear vent trim 120 on the top of the housing 102 and at a rear side of the top of the housing 102, the rear vent trim 120 having an upper surface 126 that is substantially flush with the upper surface 106*a* of the cooking surface 106, the rear vent trim 120 including an opening (e.g., 128, 130, 134, and/or 136) permitting air (e.g., A1, A2, and/or A3) to exit from within the rear vent trim 120, and the rear vent trim 120 directing the air away from a 90° angle with respect to the upper surface 106*a* of the cooking surface 106.

Another exemplary embodiment is directed to a home cooking appliance 100 comprising a housing 102, a cooking surface 106 on a top of the housing 102, the cooking surface 106 having an upper surface 106*a*, and a rear vent trim 120 on the top of the housing 102 and at a rear side of the top of the housing 102, the rear vent trim 120 having an upper surface 126 that is substantially flush with the upper surface 106*a* of the cooking surface 106, the rear vent trim 120 including an opening (e.g., 128, 130, 134, and/or 136) permitting air (e.g., A1, A2, and/or A3) to exit from within the rear vent trim 120, and the rear vent trim 120 including means for directing (e.g., 140, 152, and/or 182) the air away from a 90° angle with respect to the upper surface 106*a* of the cooking surface 106. In another exemplary embodiment, the rear vent trim 120 includes means for directing (e.g., one or more of 128, 130, 134, 136, 140, 152, 182) the air away from a 90° angle with respect to the upper surface 106*a* of the cooking surface 106.

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing;

a cooking surface on a top of the housing, the cooking surface having an upper surface; and a rear vent trim on the top of the housing and at a rear edge of the top of the housing, the rear vent trim having an upper surface that is substantially flush with the upper surface of the cooking surface, the rear vent trim including an opening permitting air to exit from within the rear vent trim and a second opening permitting additional air to exit from within the rear vent trim, the rear vent trim directing the air away from a 90° angle with respect to the upper surface of the cooking surface, wherein the opening directs the air above the cooking surface and the second opening directs the additional air in a forward direction and toward the cooking surface, wherein the cooking surface has a side surface, the side surface facing toward the rear vent trim, and wherein the second opening directs the additional air exiting the second opening at least one of onto the side surface of the cooking surface and below the upper surface of the cooking surface.

2. The home cooking appliance of claim 1, wherein the rear vent trim includes a deflector concealed under an outer surface of the rear vent trim and disposed at a predetermined angle with respect to the upper surface of the rear vent trim, and wherein the deflector directs the air away from the 90° angle with respect to the upper surface of the cooking surface before the air exits the opening in the rear vent trim.

3. The home cooking appliance of claim 1, wherein the opening is in the upper surface of the rear vent trim.

4. The home cooking appliance of claim 1, wherein the rear vent trim includes a second upper surface disposed at an angle other than a 90° angle with respect to the upper surface of the rear vent trim and on a side of the rear vent trim that is adjacent to the cooking surface, and wherein the opening is formed in the second upper surface.

5. The home cooking appliance of claim 1, wherein the opening comprises one of:

a first opening in fluid communication with a first air channel for guiding ambient kitchen air through the housing;

a second opening in fluid communication with a second air channel for exhausting cooling air drawn through the appliance; and a third opening in fluid communication with a flue for exhausting flue gas from a cooking compartment within the housing.

6. The home cooking appliance of claim 1, wherein the rear vent trim includes a plurality of openings that permit air to exit from within the rear vent trim while directing the air away from a 90° angle with respect to the upper surface of the cooking surface.

7. The home cooking appliance of claim 6, wherein the upper surface of the rear vent trim includes the plurality of openings.

8. The home cooking appliance of claim 6, wherein the rear vent trim includes a second upper surface disposed at an angle other than a 90° angle with respect to the upper surface of the rear vent trim and on a side of the rear vent trim that is adjacent to the cooking surface, and wherein the plurality of openings are formed in the upper surface of the rear vent trim and the second upper surface of the rear vent trim.

9. The home cooking appliance of claim 6, wherein the plurality of openings comprises two of:

a first opening in fluid communication with a first air channel for guiding ambient kitchen air through the housing;

a second opening in fluid communication with a second air channel for exhausting cooling air drawn through the appliance, and a third opening in fluid communication with a flue for exhausting flue gas from a cooking compartment within the housing, wherein each of the first air channel, the second air channel, and the flue are separate from each other such that the ambient kitchen air, the cooling air, and the flue gas are prevented from mixing with each other prior to exiting the plurality of openings of the rear vent trim.

10. The home cooking appliance of claim 6, wherein the plurality of openings comprises:

a first opening in fluid communication with a first air channel for guiding ambient kitchen air through the housing, a second opening in fluid communication with a second air channel for exhausting cooling air drawn through the appliance, and a third opening in fluid communication with a flue for exhausting flue gas from a cooking compartment within the housing, wherein each of the first air channel, the second air channel, and the flue are separate from each other such that the ambient kitchen air, the cooling air drawn, and the flue gas are prevented from mixing with each other prior to exiting the rear vent trim.

11. The home cooking appliance of claim 10, wherein the rear vent trim includes a second upper surface disposed at an angle other than a 90° angle with respect to the upper surface of the rear vent trim and on a side of the rear vent trim that is adjacent to the cooking surface, wherein the upper surface of the rear vent trim includes the first opening, and wherein the second upper surface includes the second opening and the third opening.

12. The home cooking appliance of claim 5, wherein at least two of the plurality of openings have different dimensions.

13. The home cooking appliance of claim 6, wherein the plurality of openings comprises:

a first plurality of openings in fluid communication with a first air channel for guiding ambient kitchen air through the housing;

a second plurality of openings in fluid communication with a second air channel for exhausting cooling air drawn through the appliance; and a third plurality of openings in fluid communication with a flue for exhausting flue gas from a cooking compartment within the housing.

14. The home cooking appliance of claim 13, wherein the first plurality of openings, the second plurality of openings, and the third plurality of openings have different dimensions.

15. A home cooking appliance comprising:

a housing;

a cooking surface on a top of the housing, the cooking surface having an upper surface; and a rear vent trim on the top of the housing and at a rear edge of the top of the housing, the rear vent trim having an upper surface that is substantially flush with the upper surface of the cooking surface, the rear vent trim including an opening permitting air to exit from within the rear vent trim and a second opening permitting additional air to exit from within the rear vent trim, the rear vent trim directing the air away from a 90° angle with respect to the upper surface of the cooking surface, wherein the opening directs the air above the cooking surface and the second opening directs the additional air in a forward direction toward the cooking surface, wherein the rear vent trim includes a second upper surface having the second opening permitting the additional air to exit from within the rear vent trim, wherein the rear vent trim directs the air exiting from within the rear vent trim through the opening in the upper surface of the rear vent trim away from the 90° angle with respect to the upper surface of the cooking surface and above the upper surface of the cooking surface, and wherein the rear vent trim directs the additional air exiting from within the rear vent trim through the second opening in the second upper surface of the rear vent trim away from the 90° angle with respect to the upper surface of the cooking surface and below the upper surface of the cooking surface.

16. The home cooking appliance of claim 1, wherein the rear vent trim extends across the rear edge of the top of the housing and is parallel to the rear edge of the top of the housing.

17. The home cooking appliance of claim 16, wherein the rear vent trim includes a plurality of openings that permit the air to exit from within the rear vent trim while directing the air away from a 90° angle with respect to the upper surface of the cooking surface, and wherein the plurality of openings extends along the rear vent trim parallel to the rear edge of the top of the housing and adjacent to the rear edge of the top of the housing.

18. A home cooking appliance comprising:

a housing;

a cooking surface on a top of the housing, the cooking surface having an upper surface; and a rear vent trim on the top of the housing and at a rear edge of the top of the housing, the rear vent trim having an upper surface that is substantially flush with the upper surface of the cooking surface, the rear vent trim including an opening permitting air to exit from within the rear vent trim, and the rear vent trim directing the air away from a 90° angle with respect to the upper surface of the cooking surface, wherein the cooking surface includes a cooking grate, wherein the rear vent trim includes a second opening permitting additional air to exit from within the rear vent trim, and wherein the opening directs the air above the cooking grate and the second opening directs the additional air below the cooking grate.

19. The home cooking appliance of claim 18, wherein the rear vent trim includes:

a first deflector that directs the air through the opening in the rear vent trim and above the cooking grate; and a second deflector that directs the additional air through the second opening in the rear vent trim and below the cooking grate.

20. The home cooking appliance of claim 18, wherein the air directed through the opening in the rear vent trim and above the cooking grate is cooling air, and wherein the additional air directed through the second opening in the rear vent trim and below the cooking grate is flue gas.

21. A home cooking appliance comprising:

a housing;

a cooking surface on a top of the housing, the cooking surface having an upper surface; and a rear vent trim on the top of the housing and at a rear edge of the top of the housing, the rear vent trim having an upper surface that is substantially flush with the upper surface of the cooking surface, the rear vent trim including an opening permitting air to exit from within the rear vent trim, and the rear vent trim directing the air away from a 90° angle with respect to the upper surface of the cooking surface, wherein the cooking surface includes a cooking grate, wherein the rear vent trim extends across the rear edge of the top of the housing and is parallel to the rear edge of the top of the housing, wherein the rear vent trim includes:

a plurality of first openings that permit the air to exit from within the rear vent trim while directing the air away from a 90° angle with respect to the upper surface of the cooking surface, wherein the plurality of first openings extends along the rear vent trim parallel to the rear edge of the top of the housing and adjacent to the rear edge of the top of the housing; and a plurality of second openings permitting additional air to exit from within the rear vent trim, wherein the plurality of second openings is adjacent to a rear edge of the cooking grate, wherein the plurality of first openings directs the air above the cooking grate and the plurality of second openings directs the additional air below the cooking grate.

22. A home cooking appliance comprising:

a housing;

a cooking surface on a top of the housing, the cooking surface having an upper surface; and a rear vent trim on the top of the housing and at a rear edge of the top of the housing, the rear vent trim having an upper surface that is substantially flush with the upper surface of the cooking surface, the rear vent trim including an opening permitting air to exit from within the rear vent trim and a second opening permitting additional air to exit from within the rear vent trim, the rear vent trim directing the air away from a 90° angle with respect to the upper surface of the cooking surface, wherein the opening directs the air above the cooking surface and the second opening directs the additional air in a forward direction and toward the cooking surface, wherein the rear vent trim directs the additional air exiting from within the rear vent trim through the second opening of the rear vent trim away from the 90° angle with respect to the upper surface of the cooking surface and below the upper surface of the cooking surface.

23. A home cooking appliance comprising:

a housing;

a cooking compartment in the housing and accessible through a door in a front of the housing;

a cooking surface on a top of the housing, wherein the cooking surface includes a cooking grate; and a rear vent trim on the top of the housing and at a rear edge of the top of the housing, the rear vent trim having a forward edge that is substantially flush with an upper surface of the rear edge of the cooking surface, the rear vent trim directing air from within the housing away from a 90° angle with respect to the upper surface of the cooking surface, the rear vent trim including a first opening permitting air to exit from within the rear vent trim and a second opening permitting additional air to exit from within the rear vent trim, wherein the first opening directs the air above the cooking grate and the second opening directs the additional air in a forward direction toward the cooking grate and at least partially onto or at least partially below a part of the cooking grate, and wherein the second opening directs the additional air below the upper surface of the cooking surface.

24. The home cooking appliance of claim 1, wherein the rear vent trim includes a deflector that directs the air away from the 90° angle with respect to the upper surface of the cooking surface and through the opening in the rear vent trim.

25. The home cooking appliance of claim 1, wherein the second opening directs the additional air exiting the second opening directly at the side surface of the cooking surface.

26. The home cooking appliance of claim 1, wherein the opening is in the upper surface of the rear vent trim, wherein the rear vent trim includes a second upper surface disposed at an angle other than a 90° angle with respect to the upper surface of the rear vent trim and on a side of the rear vent trim that is adjacent to the cooking surface, and the second opening is formed in the second upper surface.

27. The home cooking appliance of claim 1, wherein the second opening comprises one of:

an opening in fluid communication with a first air channel for guiding ambient kitchen air through the housing;

an opening in fluid communication with a second air channel for exhausting cooling air drawn through the appliance; and an opening in fluid communication with a flue for exhausting flue gas from a cooking compartment within the housing.

28. The home cooking appliance of claim 18, wherein the opening is in the upper surface of the rear vent trim, wherein the rear vent trim includes a second upper surface disposed at an angle other than a 90° angle with respect to the upper surface of the rear vent trim and on a side of the rear vent trim that is adjacent to the cooking surface, and the second opening is formed in the second upper surface.

29. The home cooking appliance of claim 21, wherein the upper surface of the rear vent trim includes the plurality of first openings, wherein the rear vent trim includes a second upper surface disposed at an angle other than a 90° angle with respect to the upper surface of the rear vent trim and on a side of the rear vent trim that is adjacent to the cooking surface, and the plurality of second openings are formed in the second upper surface of the rear vent trim.

30. The home cooking appliance of claim 22, wherein the opening is in the upper surface of the rear vent trim, wherein the rear vent trim includes a second upper surface disposed at an angle other than a 90° angle with respect to the upper surface of the rear vent trim and on a side of the rear vent trim that is adjacent to the cooking surface, and the second opening is formed in the second upper surface.

31. The home cooking appliance of claim 22, wherein the opening comprises one of:

a first opening in fluid communication with a first air channel for guiding ambient kitchen air through the housing;

a second opening in fluid communication with a second air channel for exhausting cooling air drawn through the appliance; and a third opening in fluid communication with a flue for exhausting flue gas from a cooking compartment within the housing.

32. The home cooking appliance of claim 22, wherein the second opening comprises one of:

an opening in fluid communication with a first air channel for guiding ambient kitchen air through the housing;

an opening in fluid communication with a second air channel for exhausting cooling air drawn through the appliance; and an opening in fluid communication with a flue for exhausting flue gas from a cooking compartment within the housing.

33. The home cooking appliance of claim 22, wherein the rear vent trim extends across the rear edge of the top of the housing and is parallel to the rear edge of the top of the housing.

* * * * *